US008651473B2

(12) United States Patent
Suzuki et al.

(10) Patent No.: US 8,651,473 B2
(45) Date of Patent: Feb. 18, 2014

(54) FEEDER, FEEDING METHOD, AND IMAGE FORMING APPARATUS

(75) Inventors: Takahiro Suzuki, Tokyo (JP); Masaki Takahashi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 92 days.

(21) Appl. No.: 13/358,683

(22) Filed: Jan. 26, 2012

(65) Prior Publication Data

US 2012/0251288 A1 Oct. 4, 2012

(30) Foreign Application Priority Data

Mar. 30, 2011 (JP) ..... 2011-076414

(51) Int. Cl.
*B25C 11/00* (2006.01)

(52) U.S. Cl.
USPC ..... 270/58.33; 254/28; 270/58.07

(58) Field of Classification Search
USPC ..... 270/58.07, 58.08, 58.09, 58.33; 254/28; 227/63
See application file for complete search history.

(56) References Cited

U.S. PATENT DOCUMENTS

| | | | | |
|---|---|---|---|---|
| 5,087,027 | A * | 2/1992 | Acquaviva | 271/258.04 |
| 6,634,633 | B1 * | 10/2003 | Maruchi | 270/58.33 |
| 6,886,824 | B2 * | 5/2005 | Johdai et al. | 270/58.33 |
| 2003/0067107 | A1 * | 4/2003 | Ikeda | 270/58.33 |

FOREIGN PATENT DOCUMENTS

| | | |
|---|---|---|
| JP | 2001-063910 | 3/2001 |
| JP | 3236376 | 9/2001 |

* cited by examiner

*Primary Examiner* — Leslie A Nicholson, III
(74) *Attorney, Agent, or Firm* — Turocy & Watson, LLP

(57) ABSTRACT

In one embodiment, there is provided a feeder that includes: a feed table on which a plurality of papers are staked in one direction, wherein some of the papers are bundled by a staple; a take-out module configured to sequentially take out the stacked papers from an outermost surface of the papers; a first detector configured to detect whether or not the staple exists in the papers within a distance h measured from the outermost surface; a controller configured to control the take-out module in a first mode or a second mode. When the staple is detected in the papers within the distance h, the controller controls the take-out module in the first mode. When the staple is not detected in the papers within the distance h, the controller controls the take-out module in the second mode.

9 Claims, 10 Drawing Sheets

FEEDER, FEEDING METHOD, AND IMAGE FORMING APPARATUS

This application claims priority from Japanese Patent Application No. 2011-076414, filed on Mar. 30, 2011, the entire contents of which are hereby incorporated by reference.

BACKGROUND

1. Field

Embodiments described herein relate to a feeder, a feeding method and an image forming apparatus.

2. Description of the Related Art

For a feeder used for an image forming apparatus in which papers are reutilized, there has been proposed a device for performing a take-out operation in two steps in the following manner. In this device, from a feed table on which bundle(s) of stapled papers and unstapled papers are mixed, the bundle(s) of stapled papers is/are temporarily taken to a space for staple detection and removal to remove a staple in this space, and then the papers are taken out on a one-by-one basis.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

According to exemplary embodiments of the present invention, there is provided a feeder that includes: a feed table on which a plurality of papers are staked in one direction, wherein some of the papers are bundled by a staple; a take-out module configured to sequentially take out the stacked papers from an outermost surface of the papers; a first detector configured to detect whether or not the staple exists in the papers within a distance h measured from the outermost surface in the one direction, wherein the distance h is more than 0; and a controller configured to control the take-out module in a first mode or a second mode, wherein when the staple is detected in the papers within the distance h, the controller controls the take-out module in the first mode, in which the take-out module sequentially takes out the stacked papers in a first period, and wherein when the staple is not detected in the papers within the distance h, the controller controls the take-out module in the second mode, in which the take-out module sequentially takes out the stacked papers in a second period that is shorter than the first period.

In the present embodiment, the outermost surface of the stacked papers is described as an uppermost paper 100, but the outermost surface of the papers may be a lowermost paper instead of the uppermost paper 100.

Hereinafter, embodiments for carrying out the present invention will be described.

First Embodiment

Figure 1:
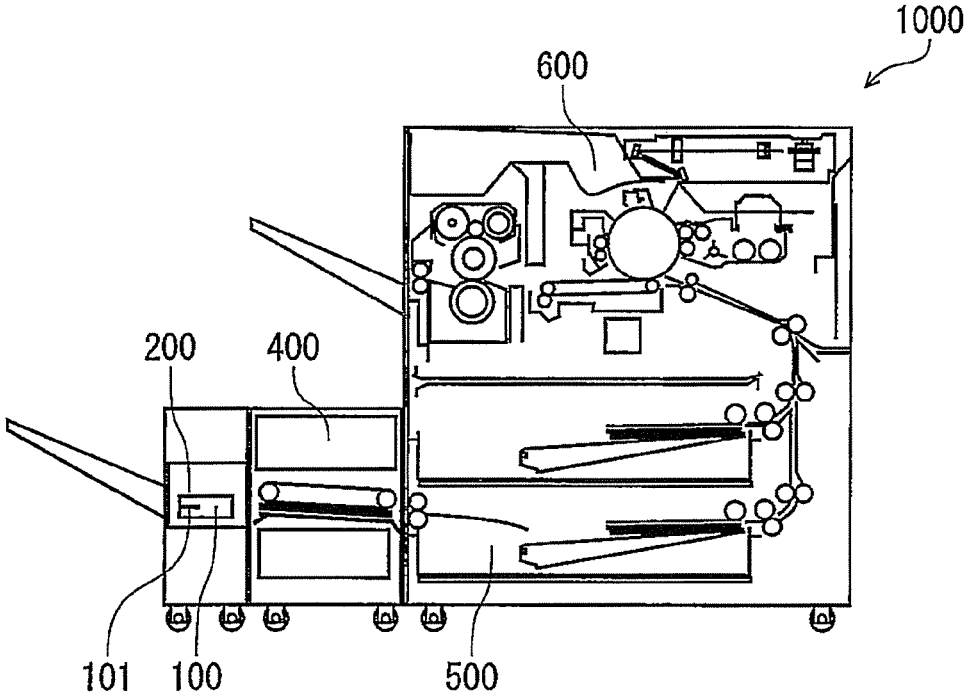
FIG. 1 is a schematic diagram illustrating an image forming apparatus provided with a feeder according to a first embodiment.

FIG. 1 is a schematic diagram illustrating an image forming apparatus 1000 in which a feeder 200 according to a first embodiment of the present invention is applied. The image forming apparatus 1000 illustrated in FIG. 1 includes: the feeder 200; a toner erasing device 400 for erasing toner from a paper; and an image forming unit 600 for performing printing on the paper.

In the image forming apparatus 1000, a printed paper, on which printing has been performed using toner erasable by heat, for example, is heated by the toner erasing device 400, thereby erasing toner from the paper. As a result, the paper from which toner has been erased is conveyed to a paper cassette 500 inside the image forming apparatus 1000, thus allowing the image forming unit 600 to perform printing on the paper again.

The feeder 200 has a plurality of printed papers 100 including a paper bundle stapled by a staple 101. Further, after the staple 101 has been removed from the paper bundle, the papers 100 are fed to the toner erasing device 400 on a one-by-one basis.

The image forming unit 600, for example, includes: a photoconductive drum; a developing unit for forming a toner image on a photoconductive drum surface; a transfer unit for transferring the toner image, formed on the photoconductive drum surface, to a surface of the paper 100; and a fuser unit for fusing the toner image on the paper. The image forming unit 600 enables the use of a technique for forming a toner image on the paper 100 by means of known electrophotography.

Furthermore, a known technique may also be used for a conveyance means for the papers 100 in the image forming apparatus 1000. Referring now to FIG. 2 to FIGS. 4A and 4B, a structure of the feeder 200 will be described below in detail.

Figure 2:
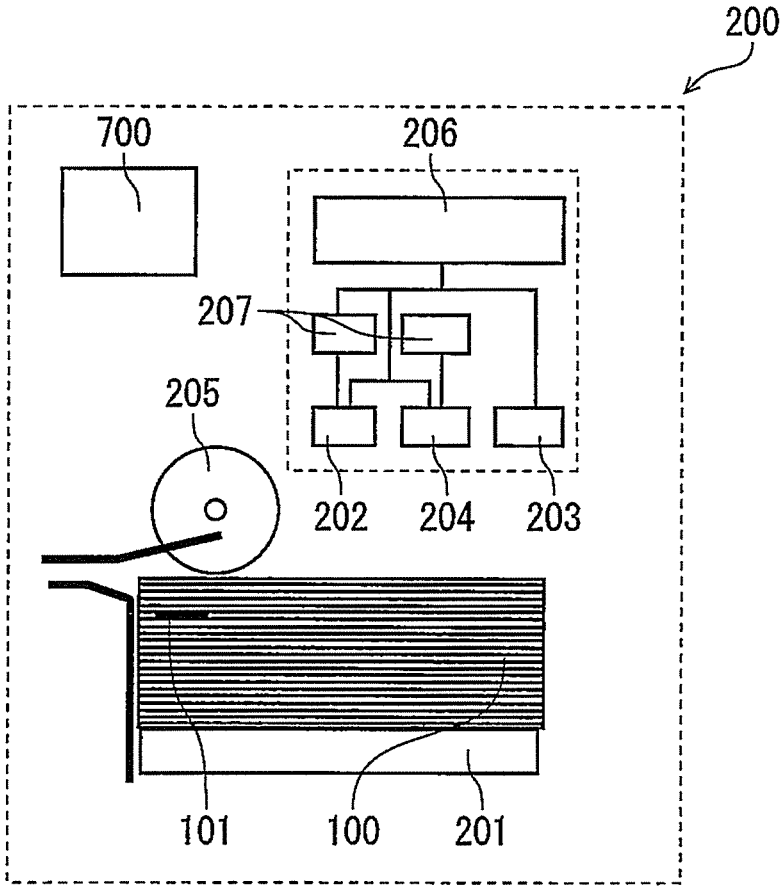
FIG. 2 is a diagram illustrating the feeder according to the first embodiment.

FIG. 2 is a diagram illustrating the structure of the feeder 200.

The feeder 200 illustrated in FIG. 2 includes: a feed table 201 on which a plurality of the papers 100, including a paper bundle stapled by the staple 101, are stacked; a first detector 202 for detecting the staple 101 that exists between the papers 100; a second detector 203 for detecting the staple 101 that exists on a surface of the uppermost paper 100; a remover 204 for removing the staple 101 that exists on the surface of the uppermost paper 100; a conveyance roller 205 for conveying the uppermost paper 100; and a controller 206.

In the present embodiment, the feeder 200 allows the first and second detectors 202 and 203, for which detection regions are different, to operate in a cooperative manner, thereby enabling more specific identification of a range in which the staple 101 exists. Further, this range is reflected on an operation for taking out the papers 100.

Specifically, in a range in which the non-existence of the staple 101 is determined by the first detector 202 that performs detection in a depth direction, the papers 100 are taken out smoothly. Further, upon determination of the existence of the staple 101 by the first detector 202, the papers 100 are taken out on a one-by-one basis during a period in which the existence of the staple 101 is not determined by the second detector 203 that performs detection within a surface, but upon determination of the existence of the staple 101 by the second detector 203, the staple 101 is removed and then the paper 100 is taken out.

The first detector 202 is a device for detecting a change in magnetic field, which is caused by the staple 101. Furthermore, based on the detected magnetic field intensity, reference is made to a table or the like which indicates a magnetic field intensity prepared in advance, for example, and a distance between the first detector 202 and the staple 101 when this intensity is obtained, thus identifying whether or not the staple 101 exists within a given depth h [mm]. The foregoing table may be stored in advance in a storage unit 700 such as a memory.

Moreover, the first detector 202 is provided so as to be movable over the uppermost paper 100 in directions of x and y axes (within a plane over the paper) by a driving mechanism 207. For a movable region in this case, a partial mode for searching a peripheral portion of the paper 100 having a high probability of existence of the staple 101 or a full mode for searching the whole surface of the paper 100 may be designated by a user by using an operation terminal (not illustrated). Besides, when the partial mode is designated, the range of the movable region may simultaneously be designated in advance in accordance with distances or the like from edges of four corners of the paper 100, for example.

Note that the partial mode is set for the foregoing movable region by default, and the following description will be made on the assumption that the partial mode is set.

The second detector 203 is a device for detecting an image on the surface of the uppermost paper 100. Further, based on the detected image, it is identified whether or not the staple 101 exists on the surface of the paper 100. Furthermore, when the staple 101 exists on the surface of the paper 100, the position and direction of the staple 101 within a plane over the paper 100 are identified.

Figure 3:
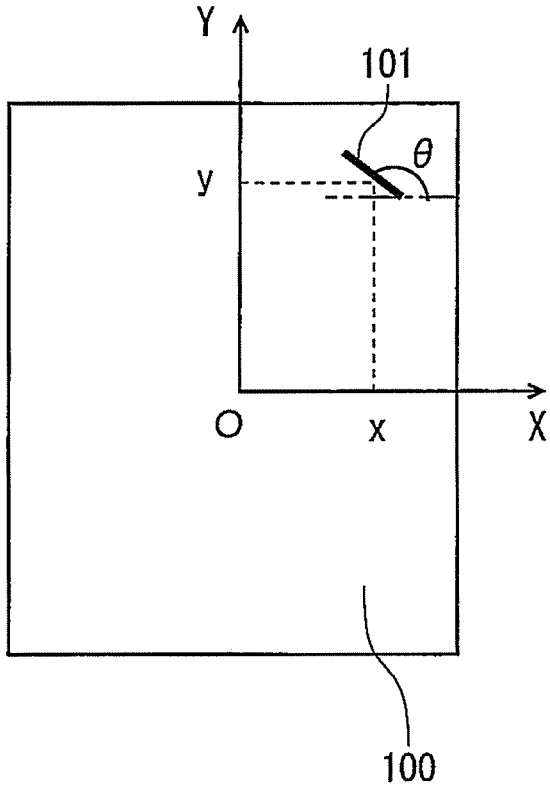
FIG. 3 is an explanatory diagram describing detection carried out by a second detector.

Specifically, as illustrated in FIG. 3, the second detector 203 sets an image coordinate system (X-Y coordinates) using the center of the paper 100 as an origin, for example, and identifies a center position of the staple 101, serving as coordinates (x, y) within this coordinate system. Further, an angle θ formed between the staple 101 and the x axis direction, for example, is detected to identify the direction of the staple 101.

In this case, an optical distance sensor (e.g., a laser sensor) may concurrently be used to detect irregularities caused by the existence of the staple, thereby enabling an improvement in accuracy.

When the staple 101 exists on the surface of the uppermost paper 100, the remover 204 removes the staple 101 from the surface of the paper 100.

Figure 4A:
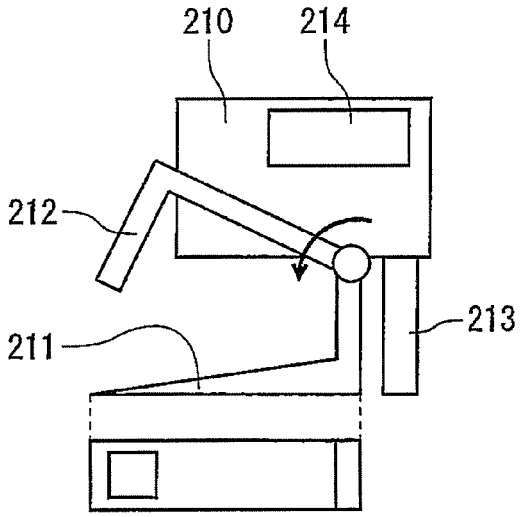
FIGS. 4A and 4B are diagrams illustrating a remover.
Figure 4B:
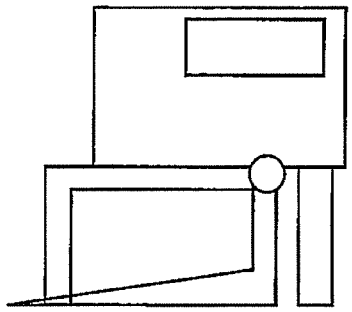

FIGS. 4A and 4B are diagrams illustrating a structure of the remover 204.

The remover 204 illustrated in FIGS. 4A and 4B includes: a main body 210 movable by the driving mechanism 207; an insertion member 211 inserted between the paper 100 and the staple 101; a movable member 212 for compressing and deforming the staple 101; a support member 213 for pressing the paper 100 and receiving a reactive force in removing the staple 101; and an actuator 214 provided inside the main body 210 to operate the movable member 212.

As illustrated in FIG. 4A, the insertion member 211 has an opening at its tip. The insertion member 211 has a width shorter than an inner width of the staple 101 which has the smallest size among the staples 101 expected in advance to be used and which is in a stapled state. Further, the insertion member 211 is formed so that its thickness is reduced toward the tip. Thus, the insertion member 211 is allowed to be easily inserted between the paper 100 and the staple 101.

The movable member 212 is rotatably provided in the main body 210, and is an L-shaped member rotated in a direction indicated by an arrow illustrated in FIG. 4A. In FIG. 4B illustrating the state where the movable member 212 has been rotated, a tip of the movable member 212 is located inside the opening of the insertion member 211.

The support member 213 is a member provided so as to be able to stand still relative to the paper 100 even when the main body 210 is operated. As will be described later, the main body 210 has to be operated in removing the staple 101, but in this case, the support member 213 presses the paper 100 and thus receives a reactive force incident to an operation for removing the staple 101.

Further, the support member 213 is capable of detecting a pressure applied when the paper is pressed, and is thus capable of carrying out alignment between the insertion member 211 and staple without excessively pressing the paper.

The placement position of the support member 213 is not limited to the illustrated position, but may be located in the vicinity of a tip portion of the insertion member 211. Alternatively, the insertion member 211 may have the functions of the support member 213.

The actuator 214 rotates the movable member 212, thereby hurling the tip of the movable member 212 toward the opening of the insertion member 211.

The controller 206 is a processor such as a CPU, and controls the conveyance roller 205 by performing switching between after-mentioned modes (i.e., a high speed mode for taking out the papers 100 at a high speed and a detection mode for performing thorough detection) of a take-out operation for the papers 100. Furthermore, the controller 206 controls the driving mechanism 207 for driving the first detector 202 and the main body 210 of the remover 204, and also controls the first and second detectors 202 and 203. Note that a known technique is used for a control method, and detailed description thereof will be omitted.

Hereinafter, operations of the feeder 200 according to the present embodiment will be described in detail with reference to FIG. 5 to FIGS. 7A to 7C.

Figure 5:
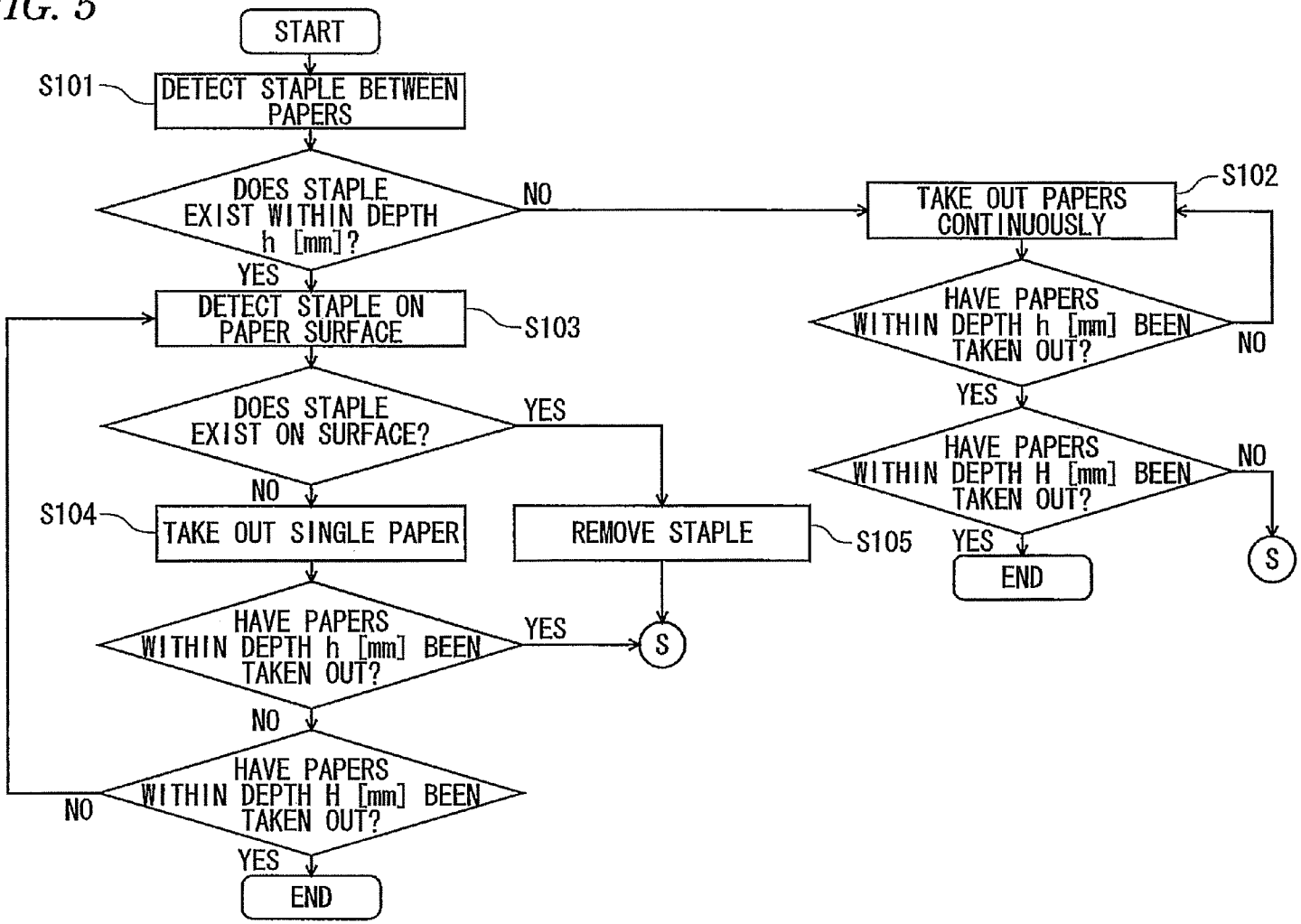
FIG. 5 is a flow chart illustrating a paper take-out operation.

FIG. 5 is a flow chart illustrating the take-out operation for the papers 100.

The first detector 202 detects the staple 101 that exists between the papers 100 within the range of the depth h [mm] which is measured from the top one of a plurality of the papers 100, stacked on the feed table 201, along the stacked direction (S 101).

Figure 6A:
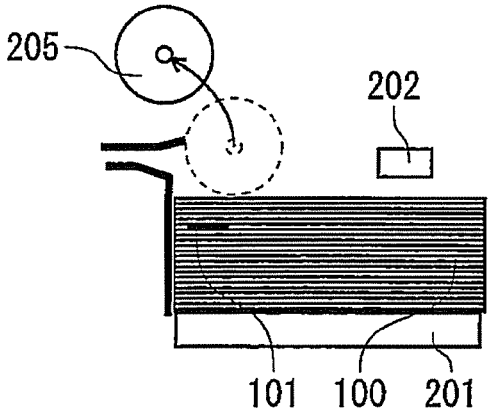
FIGS. 6A and 6B are explanatory diagrams describing detection carried out by a first detector used in the first embodiment.
Figure 6B:
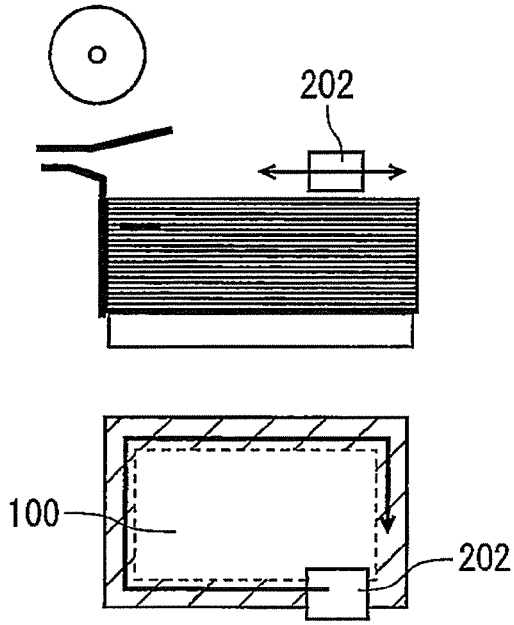

FIGS. 6A and 6B are diagrams illustrating how the staple 101 is detected by the first detector 202.

Prior to detection of the staple 101 by the first detector 202, the conveyance roller 205, which comes into contact with the uppermost paper 100 at a reference position, is withdrawn from the position located over the paper 100 and is moved to a given position (FIG. 6A).

Then, the first detector 202 is moved within a plane over the paper 100 by the driving mechanism 207 along the movable region (oblique line region) designated in advance by the user by using the terminal (FIG. 6B). During this time, the first detector 202 detects a magnetic field all the time, thereby making a search for the staple 101.

After the search has been finished for the entire movable region, the controller 206 switches the take-out operation to the high speed mode when no staple 101 is detected within the depth h [mm] by the first detector 202, and all the papers 100 in this depth range are sequentially taken out while a time interval (take-out interval) between a time at which the single paper 100 is taken out and a time at which the next paper 100 is taken out is defined as t1 (S102).

Then, when all the papers 100 within a stacking depth H [mm], which is known in advance before the start of the take-out operation for the papers 100, have not been taken out yet, the processing returns to S101, and when all the papers 100 within the stacking depth H [mm] have been taken out, the take-out operation ends. In this case, a sensor for detecting whether or not the paper(s) 100 is/are staked on the feed table 201 may additionally be prepared, and an interrupt signal for stopping the take-out operation may be generated.

Upon detection of the staple 101 within the depth h [mm] by the first detector 202, the controller 206 switches the take-out operation to the detection mode, and the second detector 203 detects the staple 101 on the surface of the uppermost paper 100 (S103).

When no staple 101 is detected by the second detector 203 in this step, the conveyance roller 205 is returned to the reference position, and the single uppermost paper 100 is taken out (S104). Then, the steps of S103 and S104 are carried out repeatedly until the second detector 203 detects the staple 101 on the surface of the paper 100.

In this case, a time interval t2 between a time at which the single paper 100 is taken out and a time at which the next paper 100 is taken out includes, for example, a traveling time of the conveyance roller 205 and/or a time required for detection carried out by the second detector 203.

Hence, since the conveyance roller 205 is allowed to be continuously located at the reference position during the high speed mode, the time interval t1 in the high speed mode is shorter than the foregoing time interval t2.

Upon detection of the staple 101 by the second detector 203, a removal operation for removing the staple 101 from the surface of the uppermost paper 100 is started (S105).

Note that when all the papers 100 within the depth h [mm] have been taken out without detection of the staple 101 by the second detector 203 in the repeated steps of S103 and S104, it is determined that false detection has been carried out by the first detector 202, and the processing returns to S101 again.

On the other hand, when all the papers 100 within the stacking depth H [mm] have been taken out without detection of the staple 101 by the second detector 203, the take-out operation ends even if false detection has been carried out by the second detector 203.

In this embodiment, for the detection within the depth h [mm] or H [mm] in the foregoing steps, for example, the number of times the papers 100 are taken out may be counted, and thus a value obtained by multiplying the counted number by a paper thickness known in advance may be used. Alternatively, when the amount of displacement of the paper 100 located at the uppermost surface is detected and/or the feed table 201 is moved upward simultaneously with the taking out of the paper 100, for example, a value obtained by detecting the amount of displacement of the feed table 201 may be used.

Figure 7A:
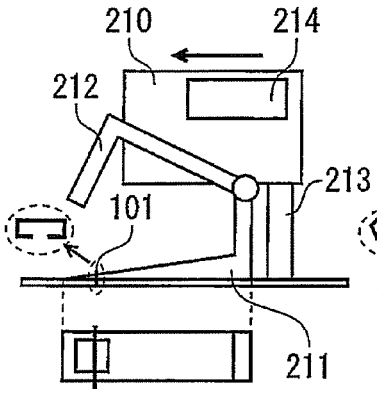
FIGS. 7A to 7C are explanatory diagrams describing operations of the remover.
Figure 7B:
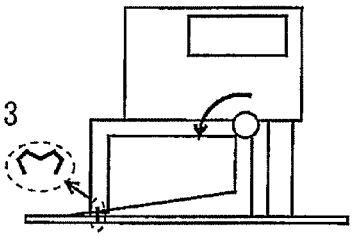
Figure 7C:
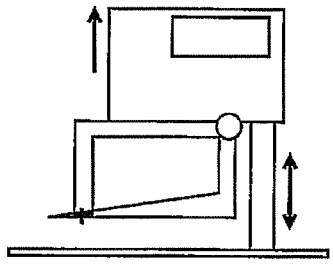

FIGS. 7A to 7C are diagrams illustrating how the staple 101 is removed from the surface of the paper 100.

Referring to FIGS. 7A to 7C, the remover 204 obtains, from the second detector 203, the position and direction of the staple 101 on the surface of the paper 100, which have been detected by the second detector 203. Then, the main body 210 of the remover 204 is driven within a plane over the paper by the driving mechanism 207, thereby moving the remover 204 to a position above the staple 101.

Subsequently, in a state where the periphery of the staple 101 is pressed by the support member 213, the insertion member 211 is inserted between the staple 101 and the paper 100 vertically with respect to the direction of the staple 101 within the plane over the paper (FIG. 7A). In this case, the insertion member 211 comes to rest in a state where the staple 101 is located over the opening of the insertion member 211. Also in this case, the remover 204 is capable of detecting a state of contact between the staple 101 and the insertion member 211 based on: pressure information obtained from the support member 213 or the insertion member 211; and staple visual information obtained from the second detector 203.

In this state, the actuator 214 actuates the movable member 212, thereby compressing the staple 101, located over the opening, toward the paper 100 (FIG. 7B). In this case, as illustrated in FIG. 7B, the staple 101 is deformed into an M shape due to a shearing force applied by the insertion member 211 and the movable member 212.

Finally, with the insertion member 211 kept inserted between the staple 101 and the paper 100, the main body 210 of the remover 204 is driven vertically with respect to the plane over the paper by the driving mechanism 207, thereby removing the staple 101 from the surface of the paper 100 (FIG. 7C). The staple 101 removed at this time is dumped in a staple dump box (not illustrated) provided inside the feeder 200. In this case, the dump box may have a magnetic property, thus allowing metal staples having magnetic properties to be easily collected.

The feeder 200 according to the present embodiment is capable of smoothly taking out the papers 100 because the papers 100 are taken out continuously on a one-by-one basis within the depth range in which the non-existence of the staple 101 is determined by the first detector 202. Further, within the range in which the staple 101 exists, the papers 100 are taken out on a one-by-one basis while the existence of the staple 101 is checked by the second detector 203, thereby making it possible to reduce the occurrence of situations where a paper bundle stapled by the staple 101 is erroneously taken out, and to prevent time loss caused by jamming.

Thus, the feeder 200 is capable of efficiently taking out the papers 100 by increasing the speed at which the papers 100 are taken out.

Second Embodiment

Hereinafter, the feeder 200 according to a second embodiment of the present invention will be described in detail with reference to FIGS. 8A to 8C.

The feeder 200 according to the present embodiment differs from the feeder 200 according to the first embodiment in the drivable range of the first detector 202 when the first detector 202 makes a search for the staple 101.

Figure 8A:
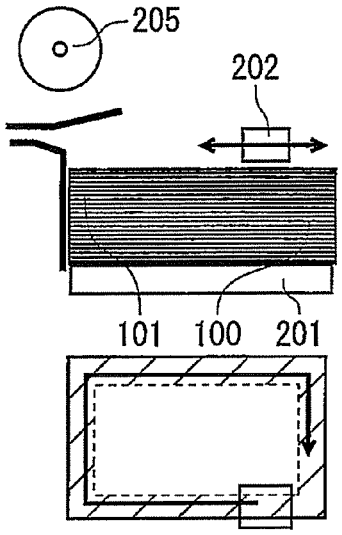
FIGS. 8A to 8C are explanatory diagrams describing detection carried out by a first detector used in a second embodiment of the present invention.
Figure 8B:
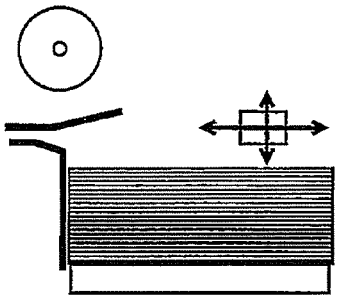
Figure 8C:
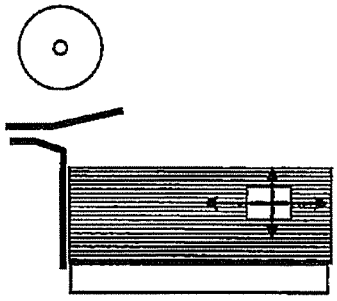

FIGS. 8A to 8C are diagrams illustrating how the staple 101 is detected by the first detector 202.

Similarly to the first embodiment, the first detector 202 is moved within a plane over the paper 100 by the driving mechanism 207 along a movable region designated in advance by a user by using a terminal (FIG. 8A).

Further, in the present embodiment, in addition to the movement within the plane over the paper, the first detector 202 is moved vertically with respect to the plane over the paper, thereby making it possible to change the distance between the first detector 202 and the surface of the paper 100 (FIG. 8B). As a result, when the staple 101 has been detected within the movable region, the distance between the first detector 202 and the surface of the paper 100 is changed, thus enabling detection of a more specific depth, at which the staple 101 exists, by detecting a change in magnetic field intensity and by making reference to the above-mentioned table.

Moreover, the first detector 202 can move not only along a region over the surface of the paper 100 but also along a lateral surface of a bundle of the papers 100 stacked on the feed table 201 (FIG. 8C). As a result, even when the staple 101 exists at a depth at which the staple 101 cannot be detected from a position above the surface, the first detector 202 is capable of detecting the position of the staple 101 with higher accuracy.

The feeder 200 according to the present embodiment is capable of identifying the more specific position of the staple 101, thus making it possible to considerably reduce the process for detecting the staple 101 by the second detector 203 and to take out the papers 100 efficiently.

Furthermore, since the movable range of the first detector 202 is increased, the staple 101 may be detected in advance before the take-out operation for the papers 100 in a state where a given number of the papers 100 are stacked on the feed table 201. As a result, the feeder 200 according to the present embodiment is capable of taking out the papers 100 more efficiently.

MODIFIED EXAMPLE

Figure 9:
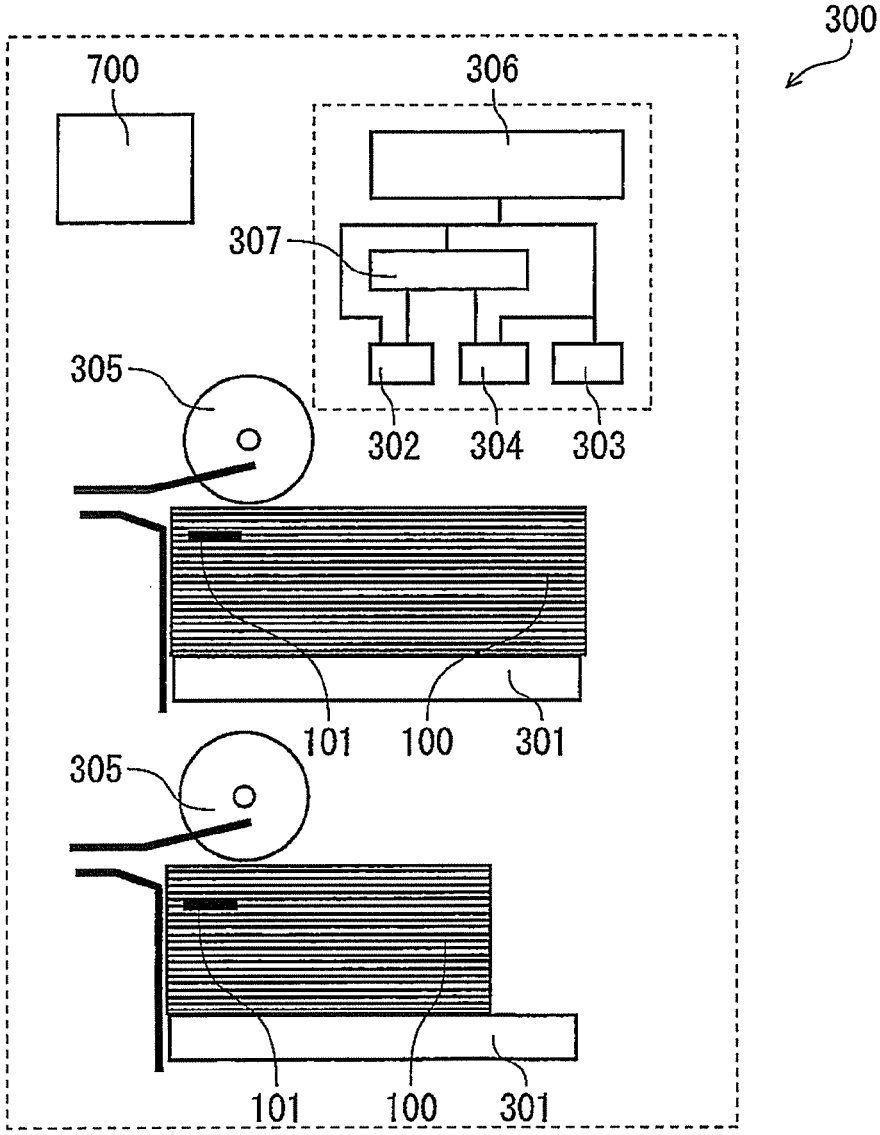
FIG. 9 is a diagram illustrating a feeder according to a modified example of the present invention.

FIG. 9 is a diagram illustrating a structure of a feeder 300 according to a modified example of the second embodiment.

The feeder 300 includes a plurality of feed tables 301, thus allowing differently-sized papers 100 to be stacked on the different feed tables 301.

Figure 10:
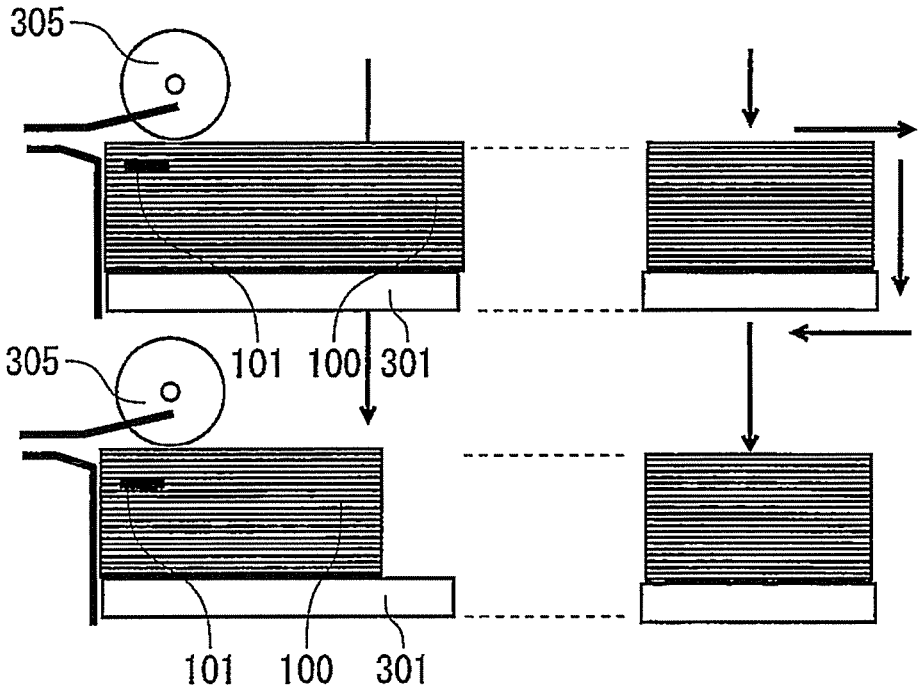
FIG. 10 is an explanatory diagram describing a unit moving path.

In this modified example, instead of providing a first detector 302, a second detector 303 and a remover 304 for each of the feed tables 301, a set of the first detector 302, the second detector 303 and the remover 304 is provided as a unit for all the feed tables 301. Further, as illustrated in FIG. 10, these components are movable in an integrated manner by a single driving mechanism 307. Note that a conveyance roller 305 may be added to the foregoing set.

In the feeder 300 according to the present modified example, the first detector 302, the second detector 303, the remover 304 and the conveyance roller 305 are movable in an integrated manner by the single driving mechanism 307, thus making it possible to reduce the number of components and to simplify the resulting structure.

Furthermore, this simple structure also facilitates movement across a plurality of the feed tables 301 along a path illustrated in FIG. 10, thus enabling an increase in design flexibility of the feeder 300 itself, which includes the provision of a plurality of the feed tables 301 in the present modified example.

Note that the first detector, the second detector and the remover are not limited to the foregoing structure. Alternatively, the first detector may only have to detect a staple that exists in a depth direction in a noncontact manner, and the second detector may only have to detect a staple that exists on a plane of the paper. Moreover, the remover may only have to remove a staple from the surface of the paper.

Further, staple detection does not necessarily have to be performed before the take-out operation for the papers 100. Alternatively, staple detection may be performed on an as-needed basis prior to the take-out operation for the papers 100 upon stacking of a given number of the papers 100 on the feed table 201 (or the feed tables 301) or upon placement of the paper(s) 100 on the feed table(s) by a user, for example. Furthermore, in that case, the user may provide an instruction via an operation terminal in order to start the take-out operation.

Besides, although the example in which the papers 100 are stacked on the feed table(s) in a vertical direction has been provided in the above description, the papers 100 may be stacked in a lateral direction. In that case, the foregoing depth h may be regarded as a lateral distance h from the paper 100 located at one end.

The feeder according to at least one of the above-described embodiments is capable of increasing the speed at which the papers are taken out.

While certain embodiments have been described, these embodiments have been presented by way of example only, and are not intended to limit the scope of the invention. Indeed, the novel methods and systems described herein may be embodied in a variety of other forms. Furthermore, various omissions, substitutions and changes in the form of the methods and systems described herein may be made without departing from the sprit of the invention. The accompanying claims and their equivalents are intended to cover such forms or modifications as would fall within the scope and sprit of the invention.

What is claimed is:

1. A feeder comprising:

a feed table on which a plurality of papers are staked in one direction, wherein some of the papers are bundled by a staple;

a take-out module configured to sequentially take out the stacked papers from an outermost surface of the papers;

a first detector configured to detect whether or not the staple exists in the papers within a distance h measured from the outermost surface in the one direction, wherein the distance h is more than 0; and a controller configured to control the take-out module in a first mode or a second mode, wherein when the staple is detected in the papers within the distance h, the controller controls the take-out module in the first mode, in which the take-out module sequentially takes out the stacked papers in a first period, and wherein when the staple is not detected in the papers within the distance h, the controller controls the take-out module in the second mode, in which the take-out module sequentially takes out the stacked papers in a second period that is shorter than the first period.

2. The feeder according to claim 1, further comprising:

a second detector configured to detect whether the staple exists in the outermost surface of the papers, and configured to detect a position of the staple in the outermost surface if the staple is detected in the outermost surface; and a remover configured to remove the staple from the outermost surface, based on the position of the staple detected by the second detector, wherein the controller is configured to control the second detector and the remover in the first mode.

3. The feeder according to claim 2, wherein when the staple is not detected in the outermost surface, the take-out module takes out a paper whose surface corresponds to the outermost surface of the papers in the first mode, and wherein when the staple is detected in the outermost surface, the remover removes the staple from the outermost surface and then the take-out module takes out the paper whose surface corresponds to the outermost surface in the first mode.

4. The feeder according to claim 2, wherein the second detector is configured to detect the position of the staple in the outermost surface by obtaining an image of the staple.

5. The feeder according to claim 1, wherein the first detector is configured to detect the staple in the papers in a noncontact state by detecting a change in magnetic field, which is caused by the staple.

6. The feeder according to claim 1, wherein the first detector is configured to move in the one direction and in a paper plane direction perpendicular to the one direction.

7. The feeder according to claim 1, wherein the first detector is configured to move in a direction parallel to a lateral surface of the papers and in a direction perpendicular to the direction parallel to the lateral surface of the papers.

8. An image forming apparatus comprising the feeder according to claim 1.

9. A feeding method comprising:

(a) stacking a plurality of papers on a feed table in one direction, wherein some of the papers are bundled by a staple;

(b) sequentially taking out the stacked papers from an outermost surface of the papers;

(c) detecting whether or not the staple exists in the papers within a distance h measured from the outermost surface in the one direction, wherein the distance h is more than 0, wherein step (b) comprises:

(b-1) if the staple is detected in the papers within the distance h, sequentially taking out the stacked papers in a first period; and (b-2) if the staple is not detected in the papers within the distance h, sequentially taking out the stacked papers in a second period that is shorter than the first period.

* * * * *